US011530659B2

(12) United States Patent
Kolhouse et al.

(10) Patent No.: US 11,530,659 B2
(45) Date of Patent: Dec. 20, 2022

(54) SYSTEMS AND METHODS FOR SELECTIVELY ACTIVATING ENGINE CYLINDERS TO MAINTAIN MINIMUM CYLINDER PRESSURE

(71) Applicants: CUMMINS INC., Columbus, IN (US); TULA TECHNOLOGY, INC., San Jose, CA (US)

(72) Inventors: J. Steven Kolhouse, Columbus, IN (US); Aaron William Beinborn, Columbus, IN (US); Lyle E. Kocher, Whiteland, IN (US)

(73) Assignees: Cummins Inc., Columbus, IN (US); Tula Technology, Inc., San Jose, CA (US)

( * ) Notice: Subject to any disclaimer, the term of this patent is extended or adjusted under 35 U.S.C. 154(b) by 0 days.

(21) Appl. No.: 17/622,349

(22) PCT Filed: Jul. 2, 2020

(86) PCT No.: PCT/US2020/040690
§ 371 (c)(1),
(2) Date: Dec. 23, 2021

(87) PCT Pub. No.: WO2021/007103
PCT Pub. Date: Jan. 14, 2021

(65) Prior Publication Data

US 2022/0205401 A1 Jun. 30, 2022

Related U.S. Application Data

(60) Provisional application No. 62/871,901, filed on Jul. 9, 2019.

(51) Int. Cl.
*F02D 41/00* (2006.01)
*F02D 17/02* (2006.01)
(Continued)

(52) U.S. Cl.
CPC ..... *F02D 41/0087* (2013.01); *F02D 17/02* (2013.01); *F02D 41/08* (2013.01); *F02D 13/06* (2013.01); *F02D 41/26* (2013.01)

(58) Field of Classification Search
CPC ..... F02D 41/0087; F02D 41/08; F02D 41/26; F02D 17/02; F02D 13/06
(Continued)

(56) References Cited

U.S. PATENT DOCUMENTS 5,287,279 A * 2/1994 Anan ..... F02D 41/0087 123/481
5,540,204 A * 7/1996 Schnaibel ..... F02P 5/045 123/481
(Continued)

FOREIGN PATENT DOCUMENTS

CH 710284 4/2016
DE 102015209012 B3 * 4/2016 ..... F02D 17/02
(Continued)

OTHER PUBLICATIONS

International Search Report and Written Opinion for PCT Application No. PCT/US2020/040690, dated Sep. 10, 2020.

*Primary Examiner* — Mahmoud Gimie
(74) *Attorney, Agent, or Firm* — Foley & Lardner LLP

(57) ABSTRACT

A system for controlling operations of an engine comprises a plurality of cylinders and a controller operatively coupled to each of the plurality of cylinders. The controller is configured to determine an operating condition of the engine, and in response to determining that the operating condition is suitable for activating less then all cylinders of the plurality of cylinders during a cycle of the engine, determine a first firing pattern, and a second firing pattern different from the first firing pattern for activating the plurality of cylinders of the engine. The controller is configured to activate a first set of cylinders of the plurality of
(Continued)

cylinders based on the first firing pattern, and subsequent to activating the first set of cylinders, activate a second set of cylinders of the plurality of cylinders different from the first set of cylinders based on the second firing pattern.

20 Claims, 9 Drawing Sheets

(51) Int. Cl.
*F02D 41/08* (2006.01)
*F02D 13/06* (2006.01)
*F02D 41/26* (2006.01)

(58) Field of Classification Search
USPC ..... 123/198 F, 481
See application file for complete search history.

(56) References Cited

U.S. PATENT DOCUMENTS

| | | | | |
|---|---|---|---|---|
| 7,260,467 | B2 | 8/2007 | Megli et al. | |
| 10,227,939 | B2 | 3/2019 | Rayl | |
| 2002/0023615 | A1* | 2/2002 | Dreymuller | F02D 17/04 123/198 F |
| 2015/0322869 | A1* | 11/2015 | Shost | F02D 41/0087 123/481 |
| 2015/0345407 | A1 | 12/2015 | Glugla et al. | |
| 2016/0146140 | A1 | 5/2016 | Fimml et al. | |
| 2018/0058347 | A1 | 3/2018 | Zhang | |
| 2018/0149100 | A1 | 5/2018 | Shin et al. | |

FOREIGN PATENT DOCUMENTS

| | | |
|---|---|---|
| DE | 10 2018 203 935 | 5/2019 |
| GB | 2 119 853 | 11/1983 |
| WO | WO-2017/127574 | 7/2017 |

* cited by examiner 3-1

3-2

4-1

4-2

SYSTEMS AND METHODS FOR SELECTIVELY ACTIVATING ENGINE CYLINDERS TO MAINTAIN MINIMUM CYLINDER PRESSURE

CROSS-REFERENCE TO RELATED PATENT APPLICATIONS

The present application is the U.S. National Stage of PCT Application No. PCT/US2020/040690, filed Jul. 2, 2020, which claims the benefit of U.S. Provisional Application No. 62/871,901, filed Jul. 9, 2019 The entire disclosure of these applications are hereby incorporated by reference herein in their entirety.

TECHNICAL FIELD

The present disclosure relates generally to systems and methods for controlling operation of internal combustion engines.

BACKGROUND

Internal combustion engines include one or more engine cylinders structured to receive a fuel and ignite the fuel so as to produce mechanical power. For example, gasoline engines include a spark plug positioned in each cylinder that ignites an air fuel mixture inserted into each cylinder near the end of a compression stroke of the cylinder. Diesel engines are configured to achieve a compression ratio that heats air present in the cylinder to a sufficient temperature such that diesel fuel inserted into the cylinder via a fuel insertion system combusts after mixing with the compressed air present in the cylinder. During an idle condition and other times when a minimal or reduced load is exerted on the engine (e.g., when a vehicle including the engine is standing still), activating or firing all cylinders is detrimental to fuel efficiency and increases the operational cost of the engine.

SUMMARY

Embodiments described herein relate generally to systems and methods for controlling operation of an engine during idle condition of the engine, and in particular, to a controller configured to determine an idle condition of the engine, and activate different sets of cylinders during each activation cycle of the engine during the idle condition based on one or more firing patterns determined by the controller.

In some embodiments, a system for controlling operations of an engine comprises a plurality of cylinders, and a controller operatively coupled to each of the plurality of cylinders. The controller is configured to determine an operating condition of the engine, and in response to determining that the operating condition is suitable for activating less then all cylinders of the plurality of cylinders during a cycle of the engine, determine a first firing pattern and a second firing pattern different from the first firing pattern for activating the plurality of cylinders of the engine. The controller is configured to activate a first set of cylinders of the plurality of cylinders based on the first firing pattern, and subsequent to activating the first set of cylinders, activate a second set of cylinders of the plurality of cylinders different from the first set of cylinders based on the second firing pattern.

In other embodiments, a method for controlling operation of an engine comprising a plurality of cylinders comprises determining, by a controller, an operating condition of the engine. In response to determining that the operating condition is suitable for activating less then all cylinders of the plurality of cylinders during a cycle of the engine, the controller determines a first firing pattern and a second firing pattern different from the first firing pattern for activating the plurality of cylinders of the engine. The controller activates a first set of cylinders of the plurality of cylinders based on the first firing pattern. Subsequent to activating the first set of cylinders, the controller activates a second set of cylinders of the plurality of cylinders different from the first set of cylinders based on the second firing pattern.

In still other embodiments, a non-transitory computer readable medium for controlling operation of an engine comprising a plurality of cylinders, having processor-readable instructions stored thereon, such that when executed by a processor of a controller, causes the controller to perform certain operations. An operating condition of the engine is determined. In response to determining that the operating condition is suitable for activating less then all cylinders of the plurality of cylinders during a cycle of the engine, a first firing pattern and a second firing pattern different from the first firing pattern is determined for activating the plurality of cylinders of the engine. A first set of cylinders of the plurality of cylinders is activated based on the first firing pattern. Subsequent to activating the first set of cylinders, a second set of cylinders of the plurality of cylinders different from the first set of cylinders is activated based on the second firing pattern.

It should be appreciated that all combinations of the foregoing concepts and additional concepts discussed in greater detail below (provided such concepts are not mutually inconsistent) are contemplated as being part of the subject matter disclosed herein. In particular, all combinations of claimed subject matter appearing at the end of this disclosure are contemplated as being part of the subject matter disclosed herein.

BRIEF DESCRIPTION OF THE DRAWINGS

The foregoing and other features of the present disclosure will become more fully apparent from the following description and appended claims taken in conjunction with the accompanying drawings. Understanding that these drawings depict only several implementations in accordance with the disclosure and are therefore not to be considered limiting of its scope, the disclosure will be described with additional specificity and detail through use of the accompanying drawings.

Figure 1:
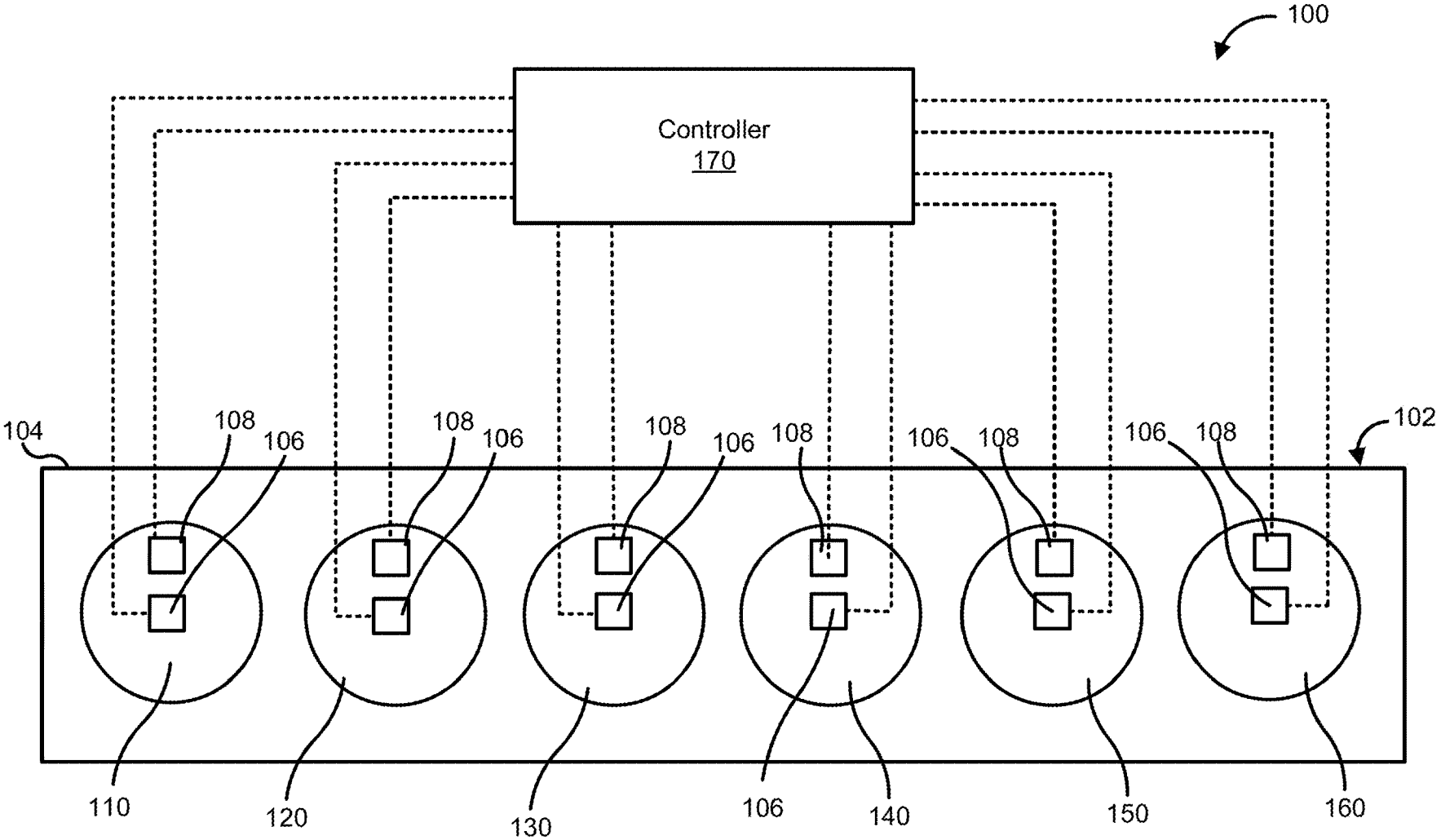
FIG. 1 is a schematic illustration of an engine including a plurality of cylinders and a controller operatively coupled to each of the plurality of cylinders, according to an embodiment.

Reference is made to the accompanying drawings throughout the following detailed description. In the drawings, similar symbols typically identify similar components unless context dictates otherwise. The illustrative implementations described in the detailed description, drawings, and claims are not meant to be limiting. Other implementations may be utilized, and other changes may be made, without departing from the spirit or scope of the subject matter presented here. It will be readily understood that the aspects of the present disclosure, as generally described herein and illustrated in the figures, can be arranged, substituted, combined, and designed in a wide variety of different configurations, all of which are explicitly contemplated and made part of this disclosure.

DETAILED DESCRIPTION

Embodiments described herein relate generally to systems and methods for controlling operation of an engine during idle condition of the engine, and in particular, to a controller configured to determine an idle condition of the engine, and activate different sets of cylinders during each activation cycle of the engine during the idle condition based on one or more firing patterns determined by the controller.

During an idle condition of an engine, the load exerted on the engine is significantly lesser than a load exerted on the engine during normal operation. In such instances, activating less than all the cylinders including in the engine is sufficient to maintain the engine in its ON (i.e., activated) condition, while consuming less fuel which increases fuel economy. Generally, only a particular set of the cylinders are activated during idle condition based on a set firing pattern while the remaining cylinders remain inactive during the engine cycles. In such instances, a minimum pressure in the inactive cylinders may drop a below a minimum threshold (e.g., a negative pressure may develop therein), causing oil to be drawn into the cylinders past piston rings of a piston disposed in the cylinder. This leads to excessive oil consumption.

In some instances, intake and/or exhaust valves of the inactive cylinders may be selectively opened in an effort to maintain pressure in all the cylinders above the minimum threshold. This may eliminate the negative pressure, but during idle conditions, sufficient boost pressure is not available in an intake manifold coupled to the cylinders to recharge the cylinders.

In contrast, various embodiments of the systems and methods described herein for controlling activation of cylinders of an engine may provide one or more benefits, including, for example: (1) activating less than all cylinders during an idle condition of the engine or any other operating condition that is suitable for activating less than all cylinders of a plurality of cylinders of the engine using a plurality of firing patterns such that all cylinders are activated over a plurality of engine cycles; (2) maintaining pressure in each of the cylinders of the engine above a minimum pressure threshold, therefore preventing oil from being drawn into the cylinder; and (3) reducing fuel consumption and therefore, increasing fuel economy while inhibiting excessive oil consumption.

As used herein, the term "activated," is used to indicate engine cylinders that are fired during an engine cycle, i.e., cylinders in which fuel is inserted during an engine cycle to effectuate combustion based on a current firing pattern.

As used herein, the term "engine cycle" implies a 360 degree rotation of a crankshaft coupled to the engine due to activation or firing of any number of cylinders of the engine.

FIG. 1 is a schematic illustration of a system 100 for controlling operation of an engine 102, according to an embodiment. The system 100 includes a plurality of cylinders of the engine 102, and a controller 170 is operatively coupled to each of the plurality of cylinders. The engine 102 includes a cylinder block 104 within which each of the plurality of cylinders are defined. As shown in FIG. 1, the engine 102 includes six-cylinders disposed inline such that the engine 102 includes a first cylinder 110, a second cylinder 120, a third cylinder 130, a fourth cylinder 140, a fifth cylinder 150, and a sixth cylinder 160 disposed inline. While shown as including six cylinders, in other embodiments the engine 102 may include any number of cylinders, for example, 2, 4, 6, 8, 10, 12, 14, 16 or even higher number of cylinders. In other arrangements, the concepts described herein may also be implemented with various internal combustion engines that do not include cylinders, for example, Wankel rotary engines.

The engine 102 includes an internal combustion engine that can be a diesel engine, a gasoline engine, a natural gas engine, a biofuel (e.g., biodiesel) engine, or a dual-fuel (e.g., diesel and natural gas) engine. A cylinder activation assembly 106 is disposed in each of the cylinders 110, 120, 130, 140, 150, 160. In some embodiments, the engine 102 may be a gasoline engine. In such embodiments, the cylinder activation assembly 106 includes a spark plug disposed in each cylinder 110, 120, 130, 140, 150, 160 and is configured to provide an ignition source (e.g., an electric spark) to ignite the fuel compressed in a corresponding cylinder 110, 120, 130, 140, 150, 160 at a specific spark time determined by the controller 170. In other embodiments, the engine 102 is a diesel engine. In such embodiments, the cylinder activation assembly 106 includes a fuel insertion assembly including a fuel injector configured to insert diesel fuel into the corresponding cylinder 110, 120, 130, 140, 150, 160.

In some embodiments, the system 100 may also include a plurality of knock sensors 108. Each knock sensor 108 is coupled to a corresponding cylinder 110, 120, 130, 140, 150, 160 and is configured to determine a knock value in each cylinder. The knock value is indicative of a likelihood of knock occurring in a cylinder 20. The knock value may be measured as an electrical signal (e.g., a current or voltage) which corresponds to an amount of vibration measured in each cylinder 110, 120, 130, 140, 150, 160, which is proportional to the knock in the respective cylinder 110, 120, 130, 140, 150, 160. In this regard, an amount of vibration beyond a certain threshold (e.g., a measured voltage being greater than a voltage threshold) may correspond to knock occurring in the corresponding cylinder 110, 120, 130, 140, 150, 160.

The controller 170 is operatively coupled to each of the plurality of cylinders 110, 120, 130, 140, 150, 160, for example, the plurality of cylinder activation assemblies 106, and may also be coupled to the plurality of knock sensors 108. The controller 170 may be operably coupled to the plurality of cylinder activation assemblies 106, the plurality of knock sensors 108 and/or other components of the engine 102, or a vehicle including the engine 102 using any type and any number of wired or wireless connections. For example, a wired connection may include a serial cable, a fiber optic cable, a CAT5 cable, or any other form of wired connection. Wireless connections may include the Internet, Wi-Fi, cellular, radio, Bluetooth, ZigBee, etc. In one embodiment, a controller area network (CAN) bus provides the exchange of signals, information, and/or data. The CAN bus includes any number of wired and wireless connections.

The controller 170 is configured to determine an operating condition of the engine 102. For example, the controller 170 is configured to determine whether the engine 102 is operating under normal condition (e.g., a vehicle including the engine 102 driving on a highway), under heavy load (e.g., travelling on an inclined road), or an operating condition that is suitable for activating less than all cylinders of the plurality of cylinders 110, 120, 130, 140, 150, 160 of the engine 102. Such conditions may include, for example, an under idle condition (e.g., vehicle standing still), a light load condition such as when a position of an accelerator pedal associated with the engine 102 is below a threshold (e.g., 30%), or the engine operating with an intake manifold pressure of an intake manifold and/or an exhaust manifold pressure of an exhaust manifold associated with the engine 102 being less than a threshold (e.g., 10 psig).

In response to determining that the engine 102 is operating under an operating condition suitable for activating less than all cylinders of the plurality of cylinders 110, 120, 130, 140, 150, 160 during a cycle of the engine 102 as previously described herein, the controller 170 is configured to determine a first firing pattern and a second firing pattern different from the first firing pattern for activating the plurality of cylinders 110, 120, 130, 140, 150, 160 of the engine 102. The controller 170 is configured to activate a first set of cylinders of the plurality of cylinders 110, 120, 130, 140, 150, 160 based on the first firing pattern, and subsequent to activating the first set of cylinders, activate a second set of cylinders of the plurality of cylinders 110, 120, 130, 140, 150, 160 different from the first set of cylinders based on the second firing pattern.

Figure 3A:
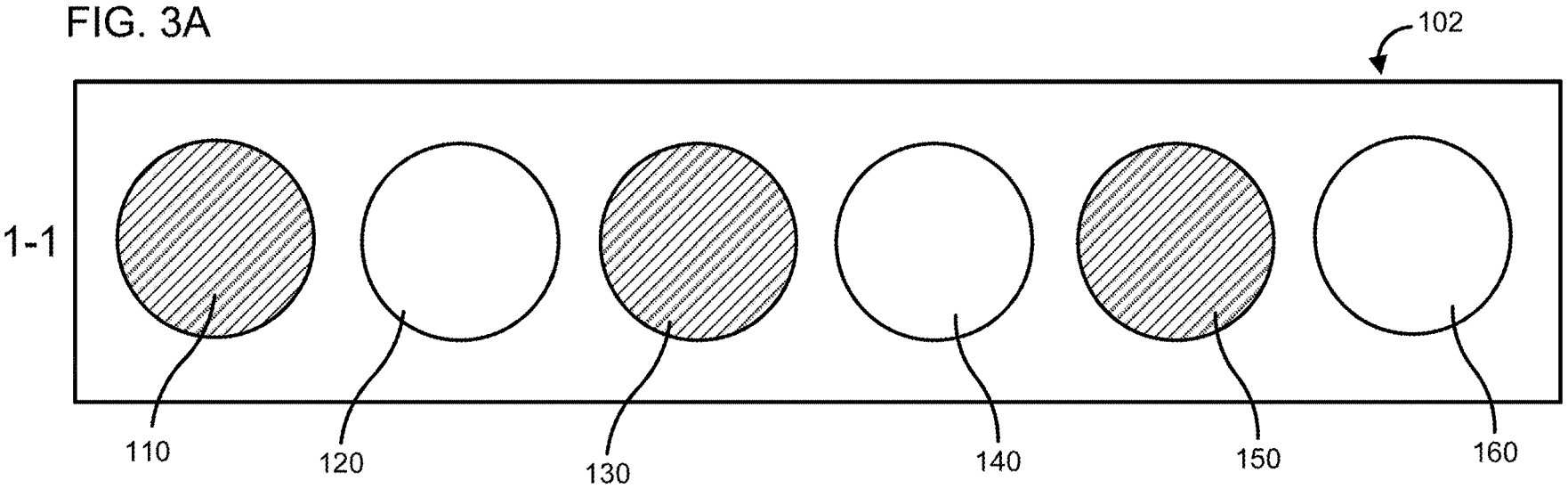
FIG. 3A shows a first firing pattern.
Figure 3B:
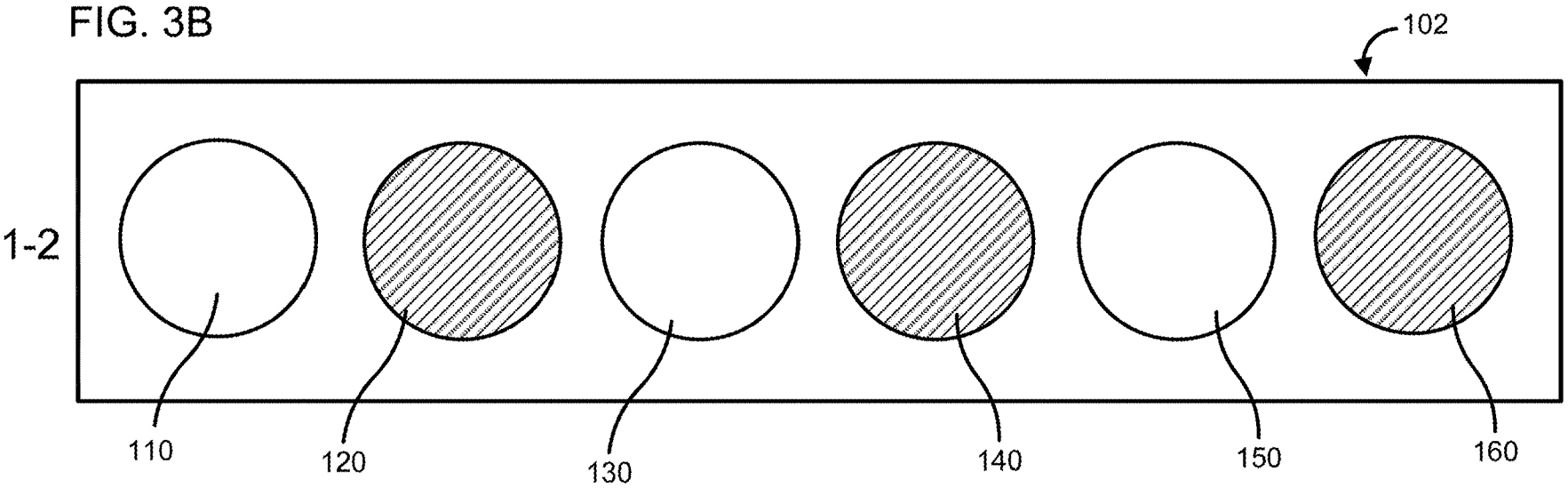
FIG. 3B shows a second firing pattern for activating various sets of the plurality of cylinders of the engine of FIG. 1 (pattern filled cylinders indicate the cylinders that are activated based on the firing pattern in a complete engine cycle), according to an embodiment.

For example, the controller 170 may determine a first firing pattern 1-1 shown in FIG. 3A for activating a first set of cylinders of the plurality of cylinders 110, 120, 130, 140, 150, 160, and a second firing pattern 1-2 shown in FIG. 3B for activating a second set of cylinders of the plurality of cylinders 110, 120, 130, 140, 150, 160. In such embodiments, the first set of cylinders activated based on the first firing pattern 1-1 shown in FIG. 3A comprises the first cylinder 110, the third cylinder 130, and the fifth cylinder 150, and the second set of cylinders activated based on the second firing pattern 1-2 of FIG. 3B comprises the second cylinder 120 located between the first cylinder 110 and the third cylinder 130, the fourth cylinder 140 located between the third cylinder 130 and the fifth cylinder 150, and the sixth cylinder 160 located adjacent to the fifth cylinder 150.

For example, during a first engine cycle, the first engine cylinder 110 may be fired followed by the fifth cylinder 150, and then the third cylinder 130 followed by skipping firing of the sixth cylinder 160, the second cylinder 120, and the fourth cylinder 120. Similarly, during a subsequent second engine cycle, the first cylinder 110, the fifth cylinder 150, and the third cylinder 130 are skipped, followed by firing of the sixth cylinder 160, the second cylinder 120, and the fourth cylinder 140, in that order. The order of firing or activation of the first set of cylinders and skipping the of second set of cylinders based on the first firing pattern or the second firing pattern may be in the order described above or in any other order based on the design of the crankshaft associated with the engine 102, which determines when a particular cylinder of the plurality of cylinders 110, 120, 130, 140, 150, 160 experiences a compression stroke. Thus, all the cylinders 110, 120, 130, 140, 150, 160 are activated in two cycles of the engine 102 ensuring that a pressure in each of the cylinders 110, 120, 130, 140, 150, 160 remains above the minimum pressure threshold even when operating less than all of the cylinders 110, 120, 130, 140, 150, 160 of the engine 102 during an idle condition of the engine 102.

Figure 4A:
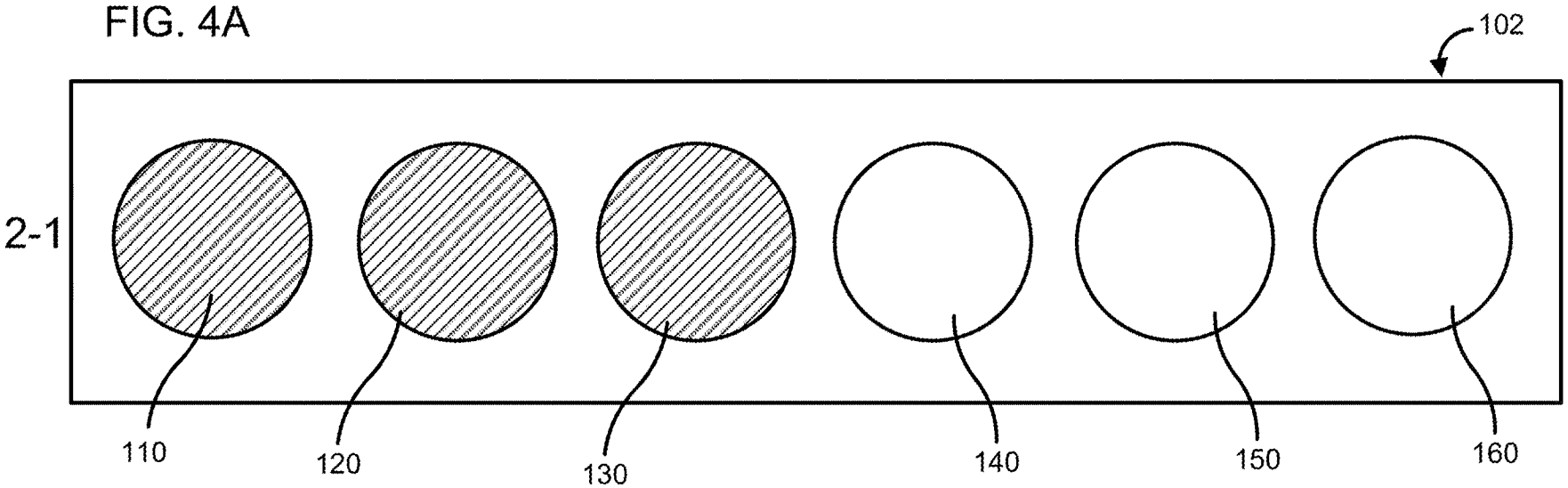
FIG. 4A shows a first firing pattern.
Figure 4B:
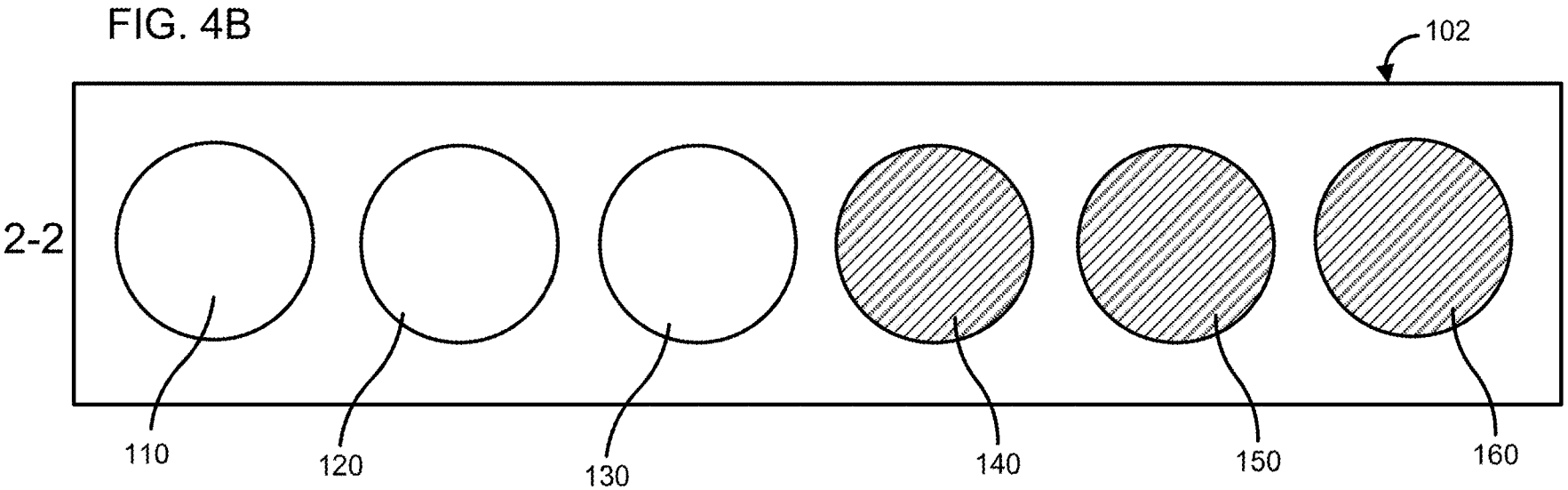
FIG. 4B shows a second firing pattern for activating various sets of the plurality of cylinders of the engine of FIG. 1 (pattern filled cylinders indicate the cylinders that are activated based on the firing pattern in a complete engine cycle), according to another embodiment.

In some embodiments, the controller 170 may determine a first firing pattern 2-1 shown in FIG. 4A for activating a first set of cylinders of the plurality of cylinders 110, 120, 130, 140, 150, 160, and a second firing pattern 2-2 shown in FIG. 4B for activating a second set of cylinders of the plurality of cylinders 110, 120, 130, 140, 150, 160. In such embodiments, the first set of cylinders activated based on the first firing pattern 2-1 include the first cylinder 110, the second cylinder 120, and the third cylinder 130 located adjacent to each other, and the second set of cylinders activated based on the second firing pattern 2-2 of FIG. 4B include the fourth cylinder 140, the fifth cylinder 150, and the sixth cylinder 160 that are located adjacent to each other. For example, during a first engine cycle, the first cylinder 110 is fired, the fifth cylinder 150 is skipped, the third cylinder 130 is fired, the sixth cylinder 160 is skipped, the second cylinder 120 is fired, and the fourth cylinder 140 is skipped in that order. In a subsequent second cycle, the first cylinder 110 is skipped, the fifth cylinder 150 is fired, the third cylinder 130 is skipped, the sixth cylinder 160 is fired, the second cylinder 120 is skipped, and the fourth cylinder 140 is fired, in that order.

Figure 5A:
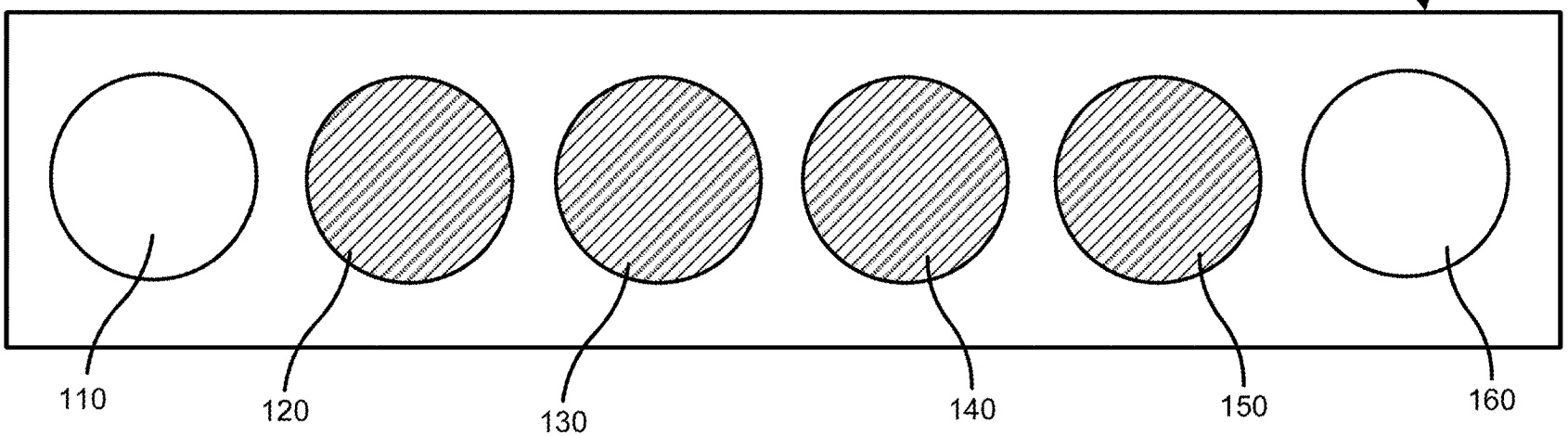
FIG. 5A shows a first firing pattern.
Figure 5B:
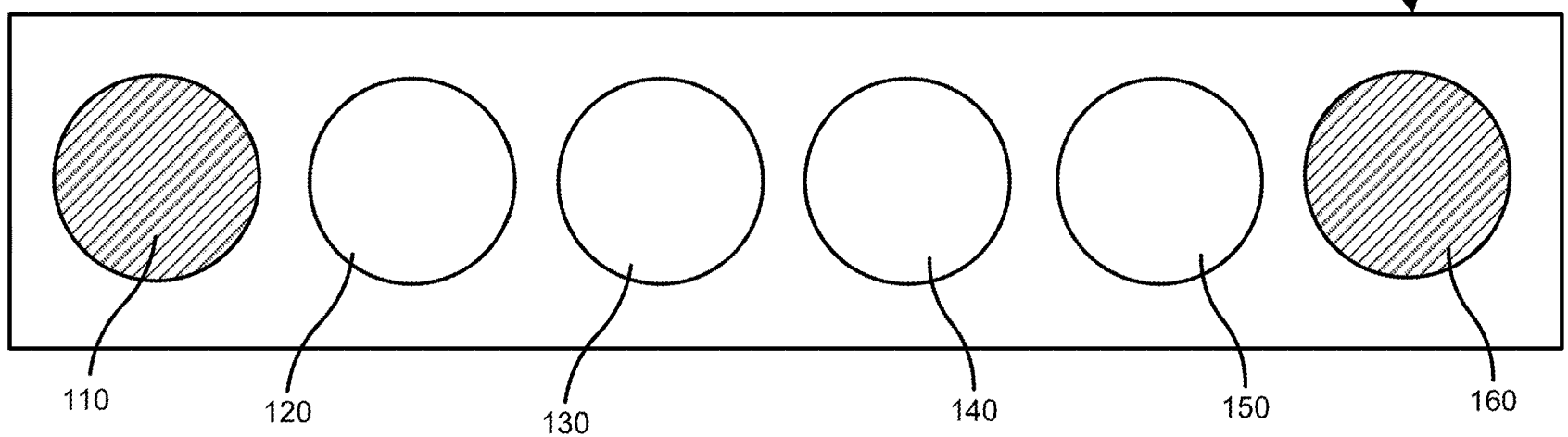
FIG. 5B shows a second firing pattern.

In some embodiments, the controller 170 may determine a first firing pattern 3-1 shown in FIG. 5A for activating a first set of cylinders of the plurality of cylinders 110, 120, 130, 140, 150, 160, and a second firing pattern 3-2 shown in FIG. 5B for activating a second set of cylinders of the plurality of cylinders 110, 120, 130, 140, 150, 160. In such embodiments, the first set of cylinders activated based on the first firing pattern 3-1 of FIG. 5A include the second cylinder 120, the third cylinder 130, the fourth cylinder 140, and the fifth cylinder 150, and the second set of cylinders activated based on the second firing pattern 3-2 of FIG. 5B include the first cylinder 110 and the sixth cylinder 160. For example, during a first engine cycle, the first cylinder 110 is skipped, the fifth cylinder 150 is fired, the third cylinder 130 is fired, the sixth cylinder 160 is skipped, the second cylinder 120 is fired, and the fourth cylinder 140 is fired in that order. In a subsequent second cycle, the first cylinder 110 is fired, the fifth cylinder 150 is skipped, the third cylinder 130 is skipped, the sixth cylinder 160 is fired, the second cylinder 120 is skipped, and the fourth cylinder 140 is skipped, in that order.

Figure 5C:
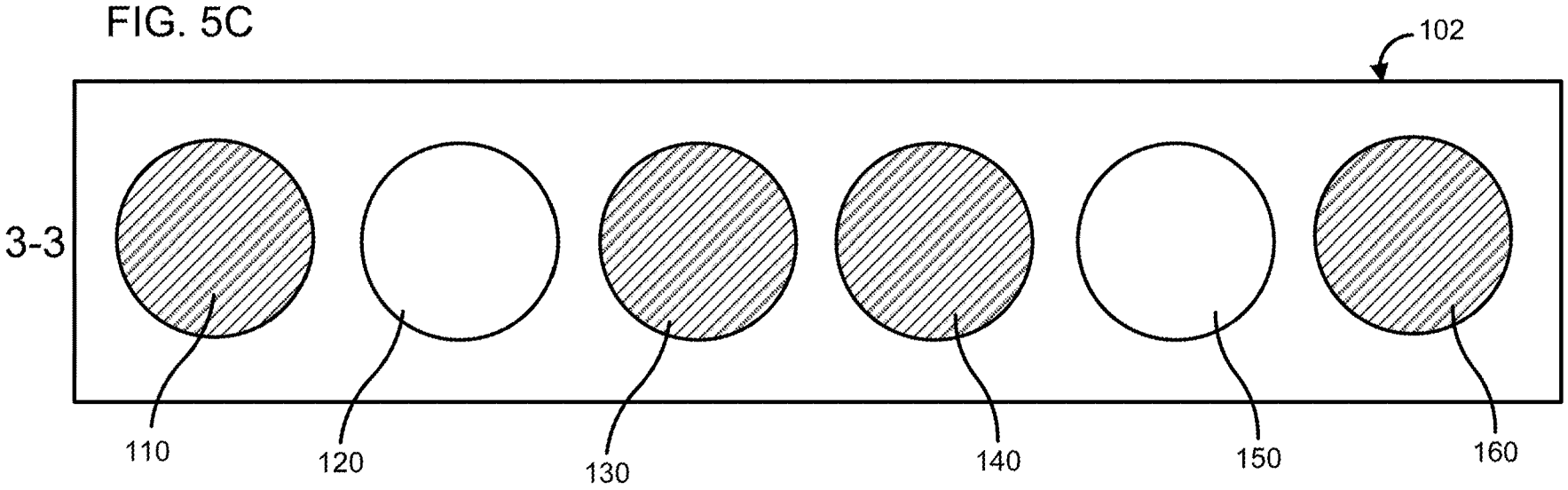
FIG. 5C shows a third firing pattern for activating various sets of the plurality of cylinders of the engine of FIG. 1 (pattern filled cylinders indicate the cylinders that are activated based on the firing pattern in a complete engine cycle), according to still another embodiment.

In some embodiments, it is possible for there to be overlap in the firing patterns, i.e., individual cylinders may be included in multiple firing patterns. By way of example, the controller 170 may also determine a third firing pattern such that the first firing pattern and the second firing pattern, or the first firing pattern and a third firing pattern, include at least one cylinder of the plurality of cylinders in common. In other words, the controller 170 may determine a plurality of firing patterns such that two or more of the firing patterns include at least one cylinder that is activated during at least two of the two or more of the firing patterns. For example, FIG. 5C shows a third firing pattern 3-3 for activating a third set of cylinders of the plurality of cylinders 110, 120, 130, 140, 150, 160. In such embodiments, the third set of cylinders activated based on the third firing pattern include the first cylinder 110, the third cylinder 130, the fourth cylinder 140, and the sixth cylinder 160. It is to be appreciated the first firing cylinder 110 and the sixth cylinder 160 are included in each of the second firing pattern 3-2 and the third firing pattern 3-3, while the third cylinder 130 and the fourth cylinder 140 are activated in each of the first firing pattern and the third firing pattern.

The controller 170 may switch from the first firing pattern to the second firing pattern after any suitable number of engine cycles or after any suitable time. In some embodiments, the controller 170 may switch from the first firing pattern to the second firing pattern after a predetermined number of cycles of one or more of the cylinder during which the cylinder (e.g., any one of the cylinders 110, 120, 130, 140, 150, 160) is not activated. In other embodiments, the controller 170 may be configured to switch from the first firing pattern to the second firing pattern based on a measured or predicted residual pressure within one (or more) cylinders that are not activated during the cycle of the engine.

In particular embodiments, the controller 170 may be configured to switch between the first firing pattern and the second firing pattern in each alternate cycle of the engine 102 (e.g., a sequence 1-2-1-2-1-2, etc., where 1 is the first firing pattern and 2 is the second firing pattern). In other embodiments, the controller 170 is configured to perform a first number of cycles of the engine 102 based on the first firing pattern, followed by an equal second number of cycles of the engine 102 based on the second firing pattern (e.g., a sequence 1-1-1-1-1-1-2-2-2-2-2-2, etc., where 1 is the first firing pattern and 2 is the second firing pattern).

In still other embodiments, the controller 170 may be configured to operate the engine 102 based on the first firing pattern for a first number of cycles, followed by a smaller number of cycles based on the second firing pattern, and then back to the first number of cycles based on the first firing pattern (e.g., 1-1-1-1-1-1-2-1-1-1-1-1-1-2). In such embodiments, an amount of fuel or air/fuel mixture inserted into the cylinders activated for the smaller number of cycles (e.g., one cycle) based on the second firing pattern may be greater than or less than the fuel or air/fuel mixture inserted into the cylinders activated based on the first firing pattern (e.g., about 60 vol % of the fuel or air/fuel mixture inserted into the cylinders activated based on the first firing pattern.)

In some embodiments, the controller 170 may be configured to determine a third firing pattern for activating the plurality of cylinders 110, 120, 130, 140, 150, 160, the third firing pattern being different from the first firing pattern and the second firing pattern. The controller 170 is configured to activate a third set of cylinders of the plurality of cylinder 110, 120, 130, 140, 150, 160 based on the third firing pattern subsequent to activating the second set of cylinders, the third set of cylinders different from the first set of cylinders and the second set of cylinders.

Figure 6A:
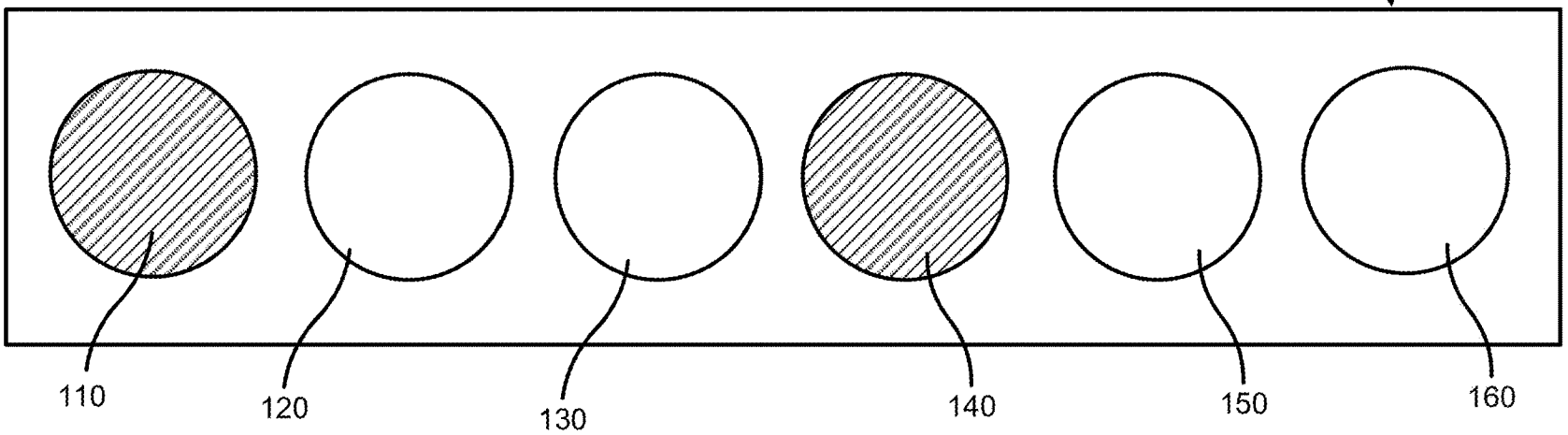
FIG. 6A shows a first firing pattern.
Figure 6B:
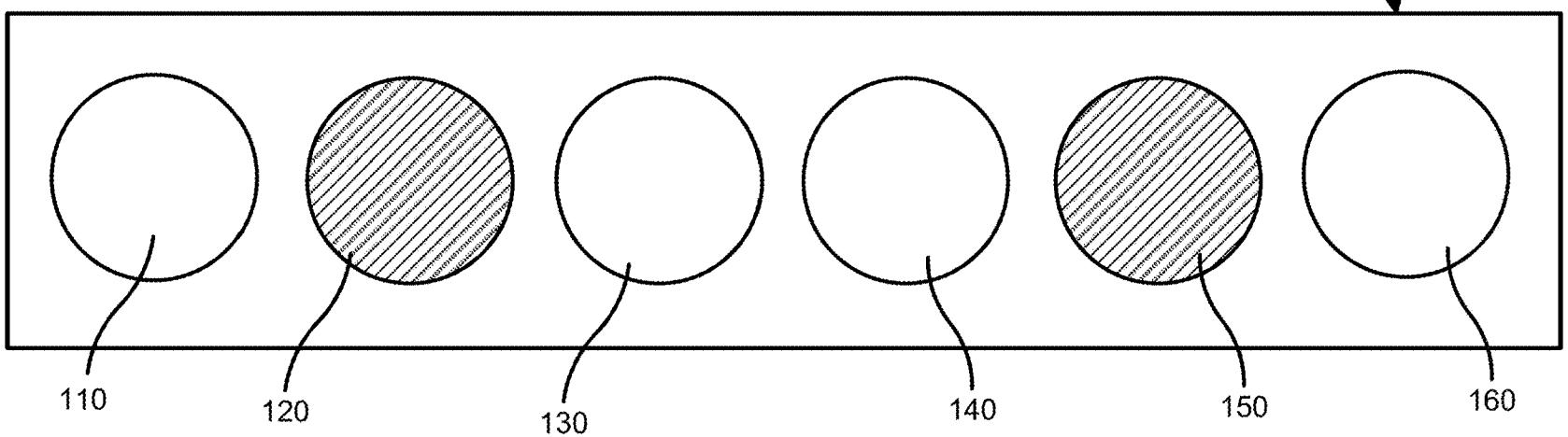
FIG. 6B shows a second firing pattern.
Figure 6C:
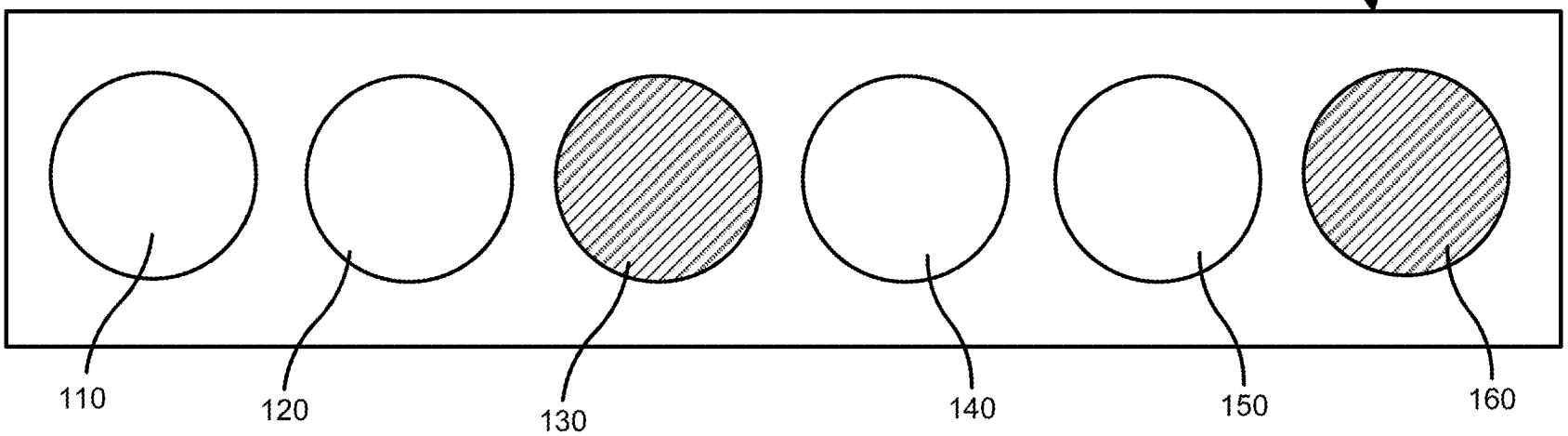
FIG. 6C shows a third firing pattern for activating a various sets of the plurality of cylinders of the engine of FIG. 1 (pattern filled cylinders indicate the cylinders that are activated based on the firing pattern in a complete engine cycle), according to yet another embodiment.

For example, the controller 170 may determine a first firing pattern 4-1 shown in FIG. 6A for activating a first set of cylinders of the plurality of cylinders 110, 120, 130, 140, 150, 160, a second firing pattern 4-2 shown in FIG. 6B for activating a second set of cylinders of the plurality of cylinders 110, 120, 130, 140, 150, 160, and a third firing pattern 4-3 shown in FIG. 6C for activating a third set of cylinders of the plurality of cylinders 110, 120, 130, 140, 150, 160. In such embodiments, the first set of cylinders activated based on the first firing pattern 4-1 of FIG. 6A include the first cylinder 110 and the third cylinder 130, the second set of cylinders activated based on the second firing pattern 4-B shown in FIG. 6B includes the second cylinder 120 and the fourth cylinder 140, and the third set of cylinders activated based on the third firing pattern 4-3 shown in FIG. 6C include the third cylinder 130 and the sixth cylinder 160. For example, during a first engine cycle, the first cylinder 110 is fired, the fifth cylinder 150 is skipped, the third cylinder 130 is skipped, the sixth cylinder 160 is skipped, the second cylinder 120 is skipped, and the fourth cylinder 140 is fired in that order. In a subsequent second cycle, the first cylinder 110 is skipped, the fifth cylinder 150 is fired, the third cylinder 130 is skipped, the sixth cylinder 160 is skipped, the second cylinder 120 is fired, and the fourth cylinder 140 is skipped, in that order. In a subsequent third cycle occurring after the second cycle, the first cylinder 110 is skipped, the fifth cylinder 150 is skipped, the third cylinder 130 is fired, the sixth cylinder 160 is fired, the second cylinder 120 is skipped, and the fourth cylinder 140 is skipped, in that order. The controller 170 may then return to the first firing pattern for the fourth cycle, and the sequence is repeated.

In some embodiments, the controller 170 is further configured to determine a third firing pattern and fourth firing pattern different from the third firing pattern. Each of the third firing pattern and the fourth firing pattern may be different from each of the first firing pattern and the second firing pattern. In such embodiments, subsequent to activating the first set of cylinders and the second set of cylinders for a first number of cycles based on the first firing pattern and the second firing pattern respectively, the controller 170 is configured to activate a third set of cylinders of the plurality of cylinders 110, 120, 130, 140, 150, 160 based on the third firing pattern, and subsequent to activating the third set of cylinders, activate a fourth set of cylinders of the plurality of cylinders 110, 120, 130, 140, 150, 160 different from the third set of cylinders based on the fourth firing pattern.

For example, in response to determining that the engine 102 is operating under idle conditions, the controller 170 may be configured to activate a first set cylinders based on the first firing pattern 1-1 shown in FIG. 3A, and subsequent to activating the first set of cylinders based on the first firing pattern 1-1, activate a second set of cylinders based on the second firing pattern 1-2 shown in FIG. 3B, as previously described herein. After the plurality of cylinders 110, 120, 130, 140, 150, 160 have been activated based on the first firing pattern 1-1 and the second firing pattern 1-2 for the first number of cycles (e.g., 1, 2, 3, 4, 5, 6, or even higher), the controller 170 is configured to determine the third firing pattern and the fourth firing pattern. In some embodiments, the controller 170 may be configured to use the first firing pattern 2-1 shown in FIG. 4A as the third firing pattern, and use the second firing pattern 2-2 shown in FIG. 4B as the fourth firing pattern. In other embodiments, the controller 170 may be configured to use the first firing pattern 3-1 shown in FIG. 5A as the third firing pattern, and the second firing pattern 3-2 shown in FIG. 5B as the fourth firing pattern.

Thus, the controller 170 may use any combination of the firing patterns shown in FIGS. 3A-3B, 4A-4B, 5A-5B, 6A-6C to activate the cylinders in any suitable sequence. It should be appreciated that while exemplary firing patterns are shown in FIGS. 3A-3B, 4A-4B, 5A-5B, 6A-6C, many other firing patterns for activating various sets of cylinders included in a 4 cylinder, a 6 cylinder, an 8 cylinder, a 10 cylinder, a 12 cylinder, an inline engine, a V-engine, a radial engine, a U engine, an H engine, a W engine, a X engine, or any other engine are contemplated. Furthermore, while the firing patterns are described above generally with respect to a 4-stroke operation of the engine 102, in other embodiments, a firing pattern may include a deviation from 4-stroke operation for one or more cylinders. For example, in various embodiments, one or more cylinders of the plurality of cylinders 110, 120, 130, 140, 150, 160 may operate in a 2-stroke, a 6-stroke or an 8-stroke operation. In such operations, a corresponding firing pattern may include more than one complete engine cycle.

Figure 2:
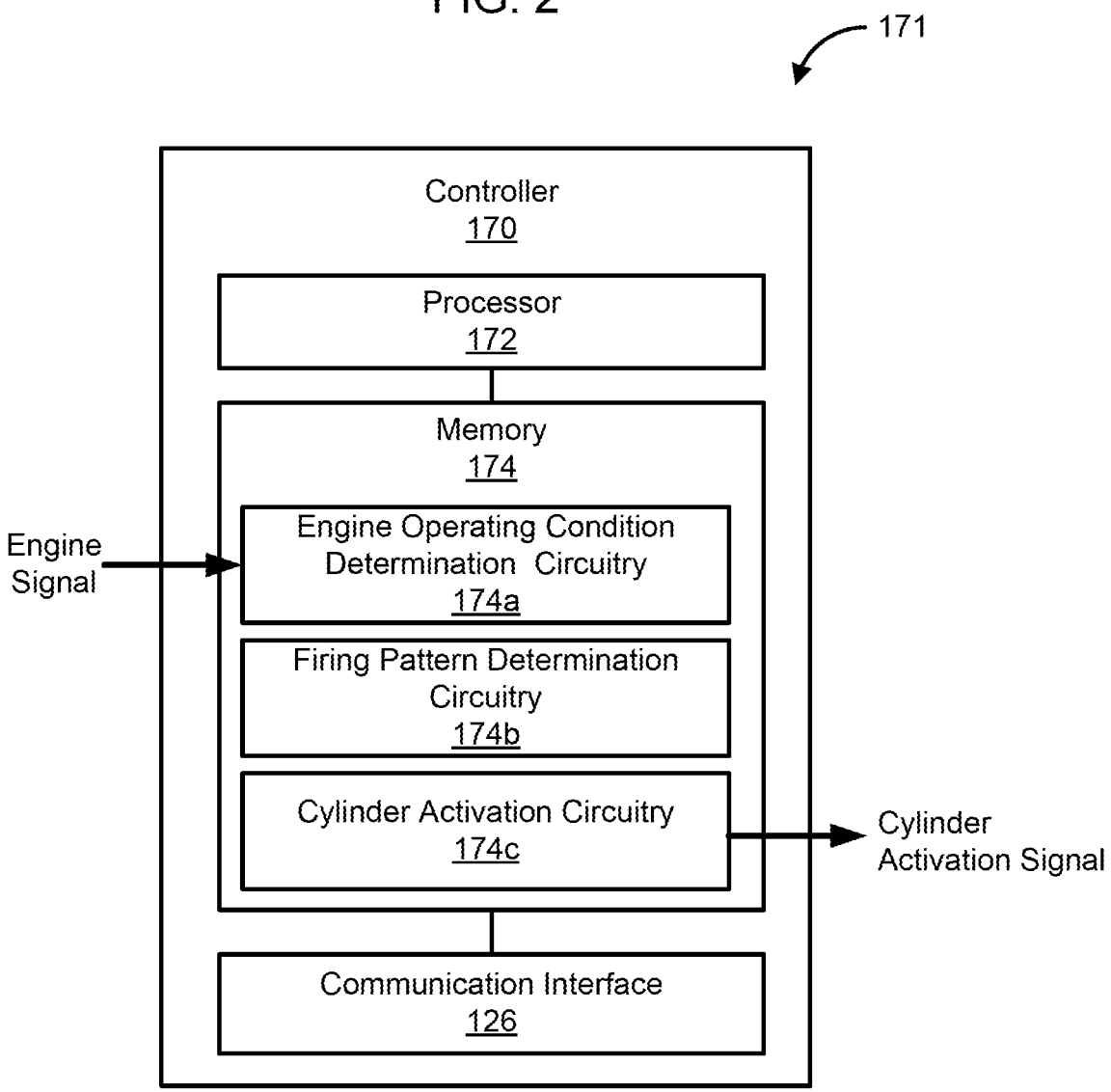
FIG. 2 is a schematic block diagram of the controller of FIG. 1.

In particular embodiments, the controller 170 may include various modules, circuitries or components configured to execute the various operations of the controller 170 as described herein. For example, FIG. 2 is a schematic block diagram of the controller 170, according to an embodiment. The controller 170 comprises a processor 172, a memory 174, or any other computer readable medium, and a communication interface 176. Furthermore, the controller 170 includes an engine operating condition determination circuitry 174*a*, a firing pattern determination circuitry 174*b*, and a cylinder activation circuitry 174*c*. It should be understood that the controller 170 shows only one embodiment of the controller 170 and any other controller capable of performing the operations described herein could be used.

The processor 172 can comprise a microprocessor, programmable logic controller (PLC) chip, an ASIC chip, or any other suitable processor. The processor 172 is in communication with the memory 174 and configured to execute instructions, algorithms, commands, or otherwise programs stored in the memory 174.

The memory 174 comprises any of the memory and/or storage components discussed herein. For example, memory 174 may comprise a RAM and/or cache of processor 172. The memory 174 may also comprise one or more storage devices (e.g., hard drives, flash drives, computer readable media, etc.) either local or remote to controller 170. The memory 174 is configured to store look up tables, algorithms, or instructions.

In one configuration, the engine operating condition determination circuitry 174*a*, the firing pattern determination circuitry 174*b*, and the cylinder activation circuitry 174*c* are embodied as machine or computer-readable media (e.g., stored in the memory 174) that is executable by a processor, such as the processor 172. As described herein and amongst other uses, the machine-readable media (e.g., the memory 174) facilitates performance of certain operations to enable reception and transmission of data. For example, the machine-readable media may provide an instruction (e.g., command, etc.) to, e.g., acquire data. In this regard, the machine-readable media may include programmable logic that defines the frequency of acquisition of the data (or, transmission of the data). Thus, the computer readable media may include code, which may be written in any programming language including, but not limited to, Java or the like and any conventional procedural programming languages, such as the "C" programming language or similar programming languages. The computer readable program code may be executed on one processor or multiple remote processors. In the latter scenario, the remote processors may be connected to each other through any type of network (e.g., CAN bus, etc.).

In another configuration, the engine operating condition determination circuitry 174*a*, the firing pattern determination circuitry 174*b*, and the cylinder activation circuitry 174*c* are embodied as hardware units, such as electronic control units. As such, the engine operating condition determination circuitry 174*a*, the firing pattern determination circuitry 174*b*, and the cylinder activation circuitry 174*c* may be embodied as one or more circuitry components including, but not limited to, processing circuitry, network interfaces, peripheral devices, input devices, output devices, sensors, etc.

In some embodiments, the engine operating condition determination circuitry 174*a*, the firing pattern determination circuitry 174*b*, and the cylinder activation circuitry 174*c* may take the form of one or more analog circuits, electronic circuits (e.g., integrated circuits, discrete circuits, system on a chip (SOCs) circuits, microcontrollers, etc.), telecommunication circuits, hybrid circuits, and any other type of "circuit." In this regard, the engine operating condition determination circuitry 174*a*, the firing pattern determination circuitry 174*b*, and the cylinder activation circuitry 174*c* may include any type of component for accomplishing or facilitating achievement of the operations described herein. For example, a circuit as described herein may include one or more transistors, logic gates (e.g., NAND, AND, NOR, OR, XOR, NOT, XNOR, etc.), resistors, multiplexers, registers, capacitors, inductors, diodes, wiring, and so on.

Thus, the engine operating condition determination circuitry 174*a*, the firing pattern determination circuitry 174*b*, and the cylinder activation circuitry 174*c* may also include programmable hardware devices such as field programmable gate arrays, programmable array logic, programmable logic devices or the like. In this regard, the engine operating condition determination circuitry 174*a*, the firing pattern determination circuitry 174*b*, and the cylinder activation circuitry 174*c* may include one or more memory devices for storing instructions that are executable by the processor(s) of the engine operating condition determination circuitry 174*a*, the firing pattern determination circuitry 174*b*, and the cylinder activation circuitry 174*c*. The one or more memory devices and processor(s) may have the same definition as provided below with respect to the memory 174 and the processor 172.

In the example shown, the controller 170 includes the processor 172 and the memory 174. The processor 172 and the memory 174 may be structured or configured to execute or implement the instructions, commands, and/or control processes described herein with respect to the engine operating condition determination circuitry 174*a*, the firing pattern determination circuitry 174*b*, and the cylinder activation circuitry 174*c*. Thus, the depicted configuration represents the aforementioned arrangement the engine operating condition determination circuitry 174*a*, the firing pattern determination circuitry 174*b*, and the cylinder activation circuitry 174*c* are embodied as machine or computer-readable media. However, as mentioned above, this illustration is not meant to be limiting as the present disclosure contemplates other embodiments such as the aforementioned embodiment where the engine operating condition determination circuitry 174*a*, the firing pattern determination circuitry 174*b*, and the cylinder activation circuitry 174*c*, or at least one circuit of the engine operating condition determination circuitry 174*a*, the firing pattern determination circuitry 174*b*, and the cylinder activation circuitry 174*c* are configured as a hardware unit. All such combinations and variations are intended to fall within the scope of the present disclosure.

The processor 172 may be implemented as one or more general-purpose processors, an application specific integrated circuit (ASIC), one or more field programmable gate arrays (FPGAs), a digital signal processor (DSP), a group of processing components, or other suitable electronic processing components. In some embodiments, the one or more processors may be shared by multiple circuits (e.g., the engine operating condition determination circuitry 174*a*, the firing pattern determination circuitry 174*b*, and the cylinder activation circuitry 174*c*) may comprise or otherwise share the same processor which, in some example embodiments, may execute instructions stored, or otherwise accessed, via different areas of memory). Alternatively, or additionally, the one or more processors may be structured to perform or otherwise execute certain operations independent of one or more co-processors. In other example embodiments, two or more processors may be coupled via a bus to enable independent, parallel, pipelined, or multi-threaded instruction execution. All such variations are intended to fall within the scope of the present disclosure. The memory 174 (e.g., RAM, ROM, Flash Memory, hard disk storage, etc.) may store data and/or computer code for facilitating the various processes described herein. The memory 174 may include a non-transitory computer readable medium that is communicably connected to the processor 172 to provide computer code or instructions to the processor 172 for executing at least some of the processes described herein. Moreover, the memory 174 may be or include tangible, non-transient volatile memory or non-volatile memory. Accordingly, the memory 174 may include database components, object code components, script components, or any other type of information structure for supporting the various activities and information structures described herein.

The communication interface 176 may include wireless interfaces (e.g., jacks, antennas, transmitters, receivers, communication interfaces, wire terminals, etc.) for conducting data communications with various systems, devices, or networks. For example, the communication interface 176 may include an Ethernet card and port for sending and receiving data via an Ethernet-based communications network and/or a Wi-Fi communication interface for communicating with each of the plurality of cylinder activation assemblies 106 and, in some embodiments, also with each of the plurality of knock sensors 108. The communication interface 176 may be structured to communicate via local area networks or wide area networks (e.g., the Internet, etc.) and may use a variety of communications protocols (e.g., IP, LON, Bluetooth, ZigBee, radio, cellular, near field communication, etc.).

The engine operating condition determination circuitry 174*a* is configured to receive an engine signal from the engine 102, and determine an operating condition of the engine 102 therefrom. For example, the engine operating condition determination circuitry 174*a* is configured to determine whether the engine 102 is operating under an operating condition suitable for activating less than all cylinders of the plurality of cylinders 110, 120, 130, 140, 150, 160 during a cycle of the engine 102, for example, operating under an idle condition, a pedal position less than a threshold, and/or intake manifold pressure and/or exhaust manifold pressure less than the minimum pressure threshold.

The firing pattern determination circuitry 174*b* is configured to determine a first firing pattern and a second firing pattern different from the first fire pattern (e.g., any of the first and second firing patterns shown in FIGS. 3A-6C) for activating a first set of cylinders and a second set of cylinders, respectively of the engine 102 in response to engine operating condition determination circuitry 174*a* determining that the engine 102 is operating in an idle condition. In some embodiments, the firing pattern determination circuitry 174*b* may also be configured to determine a third firing pattern, a fourth firing pattern, or any number of firing patterns, as described herein, each firing pattern being different from each other (e.g., any of the first and second firing patterns shown in FIGS. 3A-6C).

The cylinder activation circuitry 174*c* is configured to generate a cylinder activation signal that is communicated to a first set of cylinders of the plurality of cylinders 110, 120, 130, 140, 150, 160 based on the first firing pattern causing the first set of cylinders to activate. The controller 170 is configured to subsequently communicate the cylinder activation signal to a second set of cylinders of the plurality of cylinders 110, 120, 130, 140, 150, 160 based on the second firing pattern so as to activate the second set of cylinders, as previously described herein. In some embodiments, the controller 170 is configured to activate a third set of cylinders of the plurality of cylinders subsequent to activating the second set of cylinders based on the third firing pattern (e.g., the third firing pattern). In still other embodiments, the cylinder activation circuitry 174*c* may be configured to activate a first set of cylinders based on the first firing pattern and a second set of cylinders based on the second firing pattern for a first number of cycles. After the first number of cycles, the cylinder activation circuitry 174*c* may be configured to activate the third set of cylinders different from the first set of cylinders based on the third firing pattern, and subsequently activate a fourth set of cylinders different from the first, second and third set of cylinders based on the fourth firing pattern.

Figure 7:
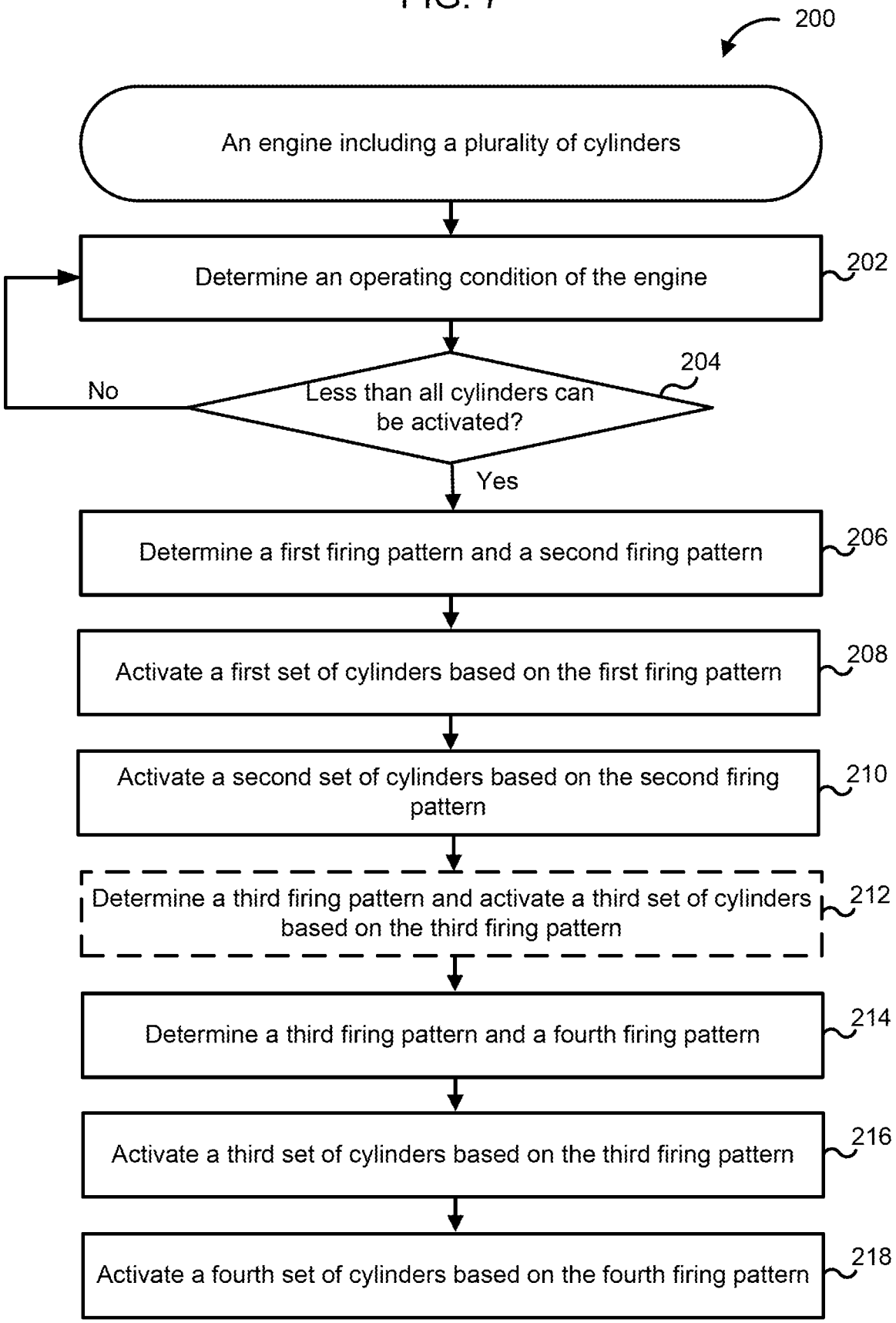
FIG. 7 is a schematic flow diagram of a method for controlling activation of a plurality of cylinders of an engine based on an operating condition of the engine, according to an embodiment.

FIG. 7 is a schematic flow diagram of a method 200 for controlling activation of a plurality of cylinders (e.g., the cylinders 110, 120, 130, 140, 150, 160) included in an engine (e.g., the engine 102) based on an operating condition of the engine, according to an embodiment. While the method 200 is described with respect to the controller 170 and the engine 102, it should be understood that the operations of the method 200 or any other method described herein may be performed with any other controller or control system (e.g., an engine control system).

The method 200 includes determining an operating condition of the engine 102 by the controller 170, at 202. At 204, the controller 170 determines if the engine 102 is operating under an operating condition that is suitable for activating less than all cylinders of the plurality of cylinders 110, 120, 130, 140, 150, 160 during an engine cycle. If the engine 102 is not operating under such an operating condition (204: NO), the method returns to operation 202. In response to determining that the engine is operating under an operating condition suitable for activating less than all cylinders of the plurality of cylinder (204:YES), the controller 170 determines a first firing pattern (e.g., the first firing pattern 1-1, 2-1, 3-1, 4-1) and a second firing pattern different from the first firing pattern, at 206 (e.g., the second firing pattern 1-2, 2-2, 3-2, 4-2).

At 208, the controller 170 activates a first set of cylinders of the plurality of cylinders 110, 120, 130, 140, 150, 160 based on the first firing pattern, as previously described herein. At 210, the controller 170 activates a second set of cylinders of the plurality of cylinders 110, 120, 130, 140, 150, 160 subsequent to activate the first set of cylinders based on the second firing pattern.

In some embodiments, the controller 170 is configured to determine a third firing pattern (e.g., the third firing pattern 4-3) different from the first firing pattern and the second firing pattern, and activates a third set of cylinders based on the third firing pattern, (shown as an optional process at 212), as previously described herein.

In some embodiments as another optional process (separate from the process shown as 212), the controller 170 determines a third firing pattern and a fourth firing pattern, each being different from the first firing pattern, the second firing pattern and each other, at 214. At 216, subsequent to activating the first set of cylinders and the second set of cylinders for a first number of cycles based on the first firing pattern and the second firing pattern, the controller 170 activates a third set of cylinders based on the third firing pattern. At 218, the controller 170 activates a fourth set of cylinders based on the fourth firing pattern subsequent to activating the third set of cylinders.

It should be noted that the term "example" as used herein to describe various embodiments is intended to indicate that such embodiments are possible examples, representations, and/or illustrations of possible embodiments (and such term is not intended to connote that such embodiments are necessarily extraordinary or superlative examples).

The term "coupled" and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

It is important to note that the construction and arrangement of the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements; values of parameters, mounting arrangements; use of materials, colors, orientations, etc.) without materially departing from the novel teachings and advantages of the subject matter described herein. Additionally, it should be understood that features from one embodiment disclosed herein may be combined with features of other embodiments disclosed herein as one of ordinary skill in the art would understand. Other substitutions, modifications, changes, and omissions may also be made in the design, operating conditions, and arrangement of the various exemplary embodiments without departing from the scope of the present embodiments.

While this specification contains many specific implementation details, these should not be construed as limitations on the scope of any embodiments or of what may be claimed, but rather as descriptions of features specific to particular implementations of particular embodiments. Certain features described in this specification in the context of separate implementations can also be implemented in combination in a single implementation. Conversely, various features described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

What is claimed is:

1. A system for controlling operations of an engine, comprising:
- a plurality of cylinders;
- a controller operatively coupled to each of the plurality of cylinders, the controller configured to:
  - determine an operating condition of the engine,
  - in response to determining that the operating condition is suitable for activating less than all cylinders of the plurality of cylinders during a cycle of the engine, determine a first firing pattern and a second firing pattern different from the first firing pattern for activating the plurality of cylinders of the engine,
  - activate a first set of cylinders of the plurality of cylinders based on the first firing pattern for a first number of cycles, and
  - subsequent to activating the first set of cylinders, activate a second set of cylinders of the plurality of cylinders different from the first set of cylinders based on the second firing pattern for a second number of cycles, different from the first number of cycles.

2. The system of claim 1, wherein the controller is further configured to:
- determine a third firing pattern for activating the plurality of cylinders, the third firing pattern being different from the first firing pattern and the second firing pattern; and
- activate a third set of cylinders of the plurality of cylinders based on the third firing pattern subsequent to activating the second set of cylinders, the third set of cylinders different from the first set of cylinders and the second set of cylinders.

3. The system of claim 2, wherein at least two of the first firing pattern, the second firing pattern, and the third firing pattern include at least one cylinder of the plurality of cylinders in common.

4. The system of claim 1, wherein the controller is further configured to:
- determine a third firing pattern and fourth firing pattern different from the third firing pattern, each of the third firing pattern and the fourth firing pattern being different from the first firing pattern and the second firing pattern;
- subsequent to activating the first set of cylinders and the second set of cylinders for a first number of cycles based on the first firing pattern and the second firing pattern, respectively, activate a third set of cylinders of the plurality of cylinders based on the third firing pattern; and
- subsequent to activating the third set of cylinders, activate a fourth set of cylinders of the plurality of cylinders different from the third set of cylinders based on the fourth firing pattern.

5. The system of claim 1, wherein the operating condition suitable for activating less then all cylinders of the plurality of cylinders during a cycle of the engine is an idle condition.

6. The system of claim 1, wherein one or more cylinders of the plurality of cylinders are operated in a 2-stroke, a 4-stroke, a 6-stroke, or an 8-stroke mode while the engine is operating under the operating condition that is suitable for activating less then all cylinders of the plurality of cylinders.

7. The system of claim 1, wherein the first firing pattern and the second firing pattern include at least one cylinder of the plurality of cylinders in common.

8. A system for controlling operations of an engine, comprising:

a plurality of cylinders;

a controller operatively coupled to each of the plurality of cylinders, the controller configured to:

determine an operating condition of the engine, in response to determining that the operating condition is suitable for activating less then all cylinders of the plurality of cylinders during a cycle of the engine, determine a first firing pattern and a second firing pattern different from the first firing pattern for activating the plurality of cylinders of the engine, activate a first set of cylinders of the plurality of cylinders based on the first firing pattern, and subsequent to activating the first set of cylinders, activate a second set of cylinders of the plurality of cylinders different from the first set of cylinders based on the second firing pattern;

wherein the plurality of cylinders include six cylinders arranged inline, and wherein the first set of cylinders activated based on the first firing pattern comprises a first cylinder, a third cylinder, and a fifth cylinder, and the second set of cylinders activated based on the second firing pattern comprises a second cylinder located between the first cylinder and the third cylinder, a fourth cylinder located between the third cylinder and the fifth cylinder, and a sixth cylinder located adjacent to the fifth cylinder.

9. A system for controlling operations of an engine, comprising:

a plurality of cylinders;

a controller operatively coupled to each of the plurality of cylinders, the controller configured to:

determine an operating condition of the engine, in response to determining that the operating condition is suitable for activating less then all cylinders of the plurality of cylinders during a cycle of the engine, determine a first firing pattern and a second firing pattern different from the first firing pattern for activating the plurality of cylinders of the engine, activate a first set of cylinders of the plurality of cylinders based on the first firing pattern, and subsequent to activating the first set of cylinders, activate a second set of cylinders of the plurality of cylinders different from the first set of cylinders based on the second firing pattern;

wherein the plurality of cylinders include six cylinders arranged inline, and wherein the first set of cylinders activated based on the first firing pattern comprises a first cylinder, a second cylinder, and a third cylinder that are located adjacent to each other, and the second set of cylinders activated based on the second firing pattern comprises a fourth cylinder, a fifth cylinder, and a sixth cylinder that are located adjacent to each other.

10. A method for controlling operation of an engine comprising a plurality of cylinders, the method comprising:

determining, by a controller, an operating condition of the engine;

in response to determining that the operating condition is suitable for activating less then all cylinders of the plurality of cylinders during a cycle of the engine, determining, by the controller, a first firing pattern and a second firing pattern different from the first firing pattern for activating the plurality of cylinders of the engine;

activating, by the controller, a first set of cylinders of the plurality of cylinders based on the first firing pattern for a first number of cycles; and subsequent to activating the first set of cylinders, activating, by the controller, a second set of cylinders of the plurality of cylinders different from the first set of cylinders based on the second firing pattern for a second number of cycles, different from the first number of cycles.

11. The method of claim 10, further comprising:

determining, by the controller, a third firing pattern for activating the plurality of cylinders, the third firing pattern being different from the first firing pattern and the second firing pattern; and activating, by the controller, a third set of cylinders of the plurality of cylinders based on the third firing pattern subsequent to activating the second set of cylinders, the third set of cylinders different from the first set of cylinders and the second set of cylinders.

12. The method of claim 11, wherein at least two of the first firing pattern, the second firing pattern, and the third firing pattern include at least one cylinder of the plurality of cylinders in common.

13. The method of claim 10, further comprising:

determining, by the controller, a third firing pattern and fourth firing pattern different from the third firing pattern, each of the third firing pattern and the fourth firing pattern being different from the first firing pattern and the second firing pattern;

subsequent to activating the first set of cylinders and the second set of cylinders for a first number of cycles based on the first firing pattern and the second firing pattern, respectively, activating, by the controller, a third set of cylinders of the plurality of cylinders based on the third firing pattern; and subsequent to activating the third set of cylinders, activating, by the controller, a fourth set of cylinders of the plurality of cylinders different from the third set of cylinders based on the fourth firing pattern.

14. The method of claim 10, wherein the operating condition suitable for activating less then all cylinders of the plurality of cylinders during a cycle of the engine is an idle condition.

15. The method of claim 10, wherein one or more cylinders of the plurality of cylinders are operated in a 2-stroke, a 4-stroke, a 6-stroke, or an 8-stroke mode while the engine is operating under the operating condition that is suitable for activating less then all cylinders of the plurality of cylinders.

16. The method of claim 10, wherein the first firing pattern and the second firing pattern include at least one cylinder of the plurality of cylinders in common.

17. A method for controlling operation of an engine comprising a plurality of cylinders, the method comprising:

determining, by a controller, an operating condition of the engine;

in response to determining that the operating condition is suitable for activating less then all cylinders of the plurality of cylinders during a cycle of the engine, determining, by the controller, a first firing pattern and a second firing pattern different from the first firing pattern for activating the plurality of cylinders of the engine;

activating, by the controller, a first set of cylinders of the plurality of cylinders based on the first firing pattern; and subsequent to activating the first set of cylinders, activating, by the controller, a second set of cylinders of the plurality of cylinders different from the first set of cylinders based on the second firing pattern;

wherein the plurality of cylinders include six cylinders arranged inline, and wherein the first set of cylinders activated based on the first firing pattern comprises a first cylinder, a third cylinder, and a fifth cylinder, and the second set of cylinders activated based on the second firing pattern comprises a second cylinder located between the first cylinder and the third cylinder, a fourth cylinder located between the third cylinder and the fifth cylinder, and a sixth cylinder located adjacent to the fifth cylinder.

18. A method for controlling operation of an engine comprising a plurality of cylinders, the method comprising:

determining, by a controller, an operating condition of the engine;

in response to determining that the operating condition is suitable for activating less then all cylinders of the plurality of cylinders during a cycle of the engine, determining, by the controller, a first firing pattern and a second firing pattern different from the first firing pattern for activating the plurality of cylinders of the engine;

activating, by the controller, a first set of cylinders of the plurality of cylinders based on the first firing pattern; and subsequent to activating the first set of cylinders, activating, by the controller, a second set of cylinders of the plurality of cylinders different from the first set of cylinders based on the second firing pattern;

wherein the plurality of cylinders include six cylinders arranged inline, and wherein the first set of cylinders activated based on the first firing pattern comprises a first cylinder, a second cylinder, and a third cylinder that are located adjacent to each other, and the second set of cylinders activated based on the second firing pattern comprises a fourth cylinder, a fifth cylinder, and a sixth cylinder that are located adjacent to each other.

19. A non-transitory computer readable medium for controlling operation of an engine comprising a plurality of cylinders, having processor-readable instructions stored thereon, such that when executed by a processor of a controller, causes the controller to perform operations, the operations comprising:

determining an operating condition of the engine;

in response to determining that the operating condition is suitable for activating less then all cylinders of the plurality of cylinders during a cycle of the engine, determining a first firing pattern and a second firing pattern different from the first firing pattern for activating the plurality of cylinders of the engine;

activating a first set of cylinders of the plurality of cylinders based on the first firing pattern for a first number of cycles; and subsequent to activating the first set of cylinders, activating a second set of cylinders of the plurality of cylinders different from the first set of cylinders based on the second firing pattern for a second number of cycles, different from the first number of cycles.

20. The non-transitory computer readable medium of claim 19, wherein the operations further comprise:

determining a third firing pattern for activating the plurality of cylinders, the third firing pattern being different from the first firing pattern and the second firing pattern; and activating a third set of cylinders of the plurality of cylinders based on the third firing pattern subsequent to activating the second set of cylinders, the third set of cylinders different from the first set of cylinders and the second set of cylinders.

* * * * *